US005685537A

United States Patent [19]

Hawn et al.

[11] Patent Number: 5,685,537

[45] Date of Patent: Nov. 11, 1997

[54] CROSS-TRACK AND SKEW JUSTIFICATION OF CUT SHEETS

[75] Inventors: Glenn Francis Hawn; John David DeLorme, both of Spencerport, N.Y.

[73] Assignee: Eastman Kodak Company, Rochester, N.Y.

[21] Appl. No.: 595,061

[22] Filed: Feb. 1, 1996

[51] Int. Cl.[6] ..... B65H 9/16

[52] U.S. Cl. ..... 271/248; 271/9.01; 271/253; 271/227

[58] Field of Search ..... 271/9.1, 9.01, 271/248, 249, 253, 255, 227, 250, 221

[56] References Cited

U.S. PATENT DOCUMENTS

| | | | |
|---|---|---|---|
| 3,244,418 | 4/1966 | Henderson | 271/59 |
| 3,921,974 | 11/1975 | Miciukiewicz | 271/240 |
| 4,657,239 | 4/1987 | Ikesue et al. | 271/227 |
| 4,836,527 | 6/1989 | Wong | 271/251 |
| 4,908,673 | 3/1990 | Muramatsu | 355/311 |
| 4,949,134 | 8/1990 | Iwaki et al. | 271/253 |
| 5,110,113 | 5/1992 | Kanaya | 271/241 |
| 5,172,138 | 12/1992 | Okazawa et al. | 346/134 |
| 5,251,889 | 10/1993 | Spencer et al. | 271/171 |
| 5,358,236 | 10/1994 | Maass et al. | 271/248 |
| 5,379,998 | 1/1995 | Nakagawa | 271/248 |

FOREIGN PATENT DOCUMENTS

| | | | |
|---|---|---|---|
| 0075745 | 4/1986 | Japan | 271/248 |
| 0185757 | 8/1988 | Japan | 271/253 |
| 404113876 | 4/1992 | Japan | 271/227 |

*Primary Examiner*—H. Grant Skaggs

*Attorney, Agent, or Firm*—Nelson Adrian Blish

[57] ABSTRACT

A justification apparatus, which receives cut sheets of different widths along a path in an in-track direction of travel, aligns the sheets relative to an in-track axis. The apparatus includes a tray having a planar surface for receiving unconstrained sheets. An edge abutment is movable in opposed directions parallel to the plane of the tray surface so as to contact a side edge of a sheet received on the surface to move the sheet with the edge abutment. The edge abutment is sequentially movable (i) away from the in-track axis to a position spaced from the in-track axis a distance sufficient to allow loading a first sheet of predetermined width onto the tray surface with more than half of the width of the first sheet between the in-track axis and the edge abutment, (ii) toward the in-track axis to a position spaced from the in-track axis by a first predetermined distance so as to effect cross-track directional and skew alignment of the first sheet to the in-track axis, and (iii) away from the in-track axis to a position spaced from the in-track axis by a distance sufficient to allow loading a second cut sheet of predetermined width onto the tray surface with at least half of the width of the second sheet between the in-track axis and the edge abutment, the predetermined width of the second sheet being different from the predetermined width of the first cut sheet, and (iv) toward the in-track axis to a position spaced from the in-track axis by a second predetermined distance so as to effect cross-track and skew alignment of the second sheet to the center line, the second predetermined distance being different from the first predetermined distance by approximately one half the predetermined width of the difference between the width of the first cut sheet and the width of the second sheet.

7 Claims, 10 Drawing Sheets

CROSS-TRACK AND SKEW JUSTIFICATION OF CUT SHEETS

BACKGROUND OF THE INVENTION

1. Technical Field

This invention relates generally to imaging apparatus, and more particularly to a sheet justification apparatus for cross-track and skew alignment of a sheet with an imaging drum.

2. Background Art

In a commercial color proofer, receiver and donor material is supplied from rolls, and cut to length. After cutting, the sheets are justified against an edge abutment along the path from the roll to the imaging drum. Because the donor and receiver sheets are of different widths, the justification edge abutment is movable laterally of the sheet path so that the sheets center about a common centerline at the drum. Edge justification is effected by a set of conical rollers which shift the sheets laterally against the edge abutments. Because the rollers attempt to move the sheet in two different directions while turning about a single axis, the rollers tend to wear excessively. Relative movement of the rollers over the sheet surfaces tend to mar the surfaces.

DISCLOSURE OF THE INVENTION

It is an object of the present invention to provide cross-track and skew alignment of a cut sheet to an imaging platen, such as a drum, without damage to the sheet surface and without introducing adverse directional forces; and to accomplish this in a simple manner.

It is another object of the present invention to provide for justification of a cut sheet while the sheet is completely unrestrained, greatly reducing the risk of abrasion or scratching.

It is still another object of the present invention provide for field adjustment of the apparatus by simple means.

According to a feature of the present invention, a justification apparatus, which receives cut sheets of different widths along a path in an in-track direction of travel, aligns the sheets relative to an in-track axis. The apparatus includes a tray having a planar surface for receiving unconstrained sheets. An edge abutment is movable in opposed directions parallel to the plane of the tray surface so as to contact a side edge of a sheet received on the surface to move the sheet with the edge abutment. The edge abutment is sequentially movable (i) away from the in-track axis to a position spaced from the in-track axis a distance sufficient to allow loading a first sheet of predetermined width onto the tray surface with more than half of the width of the first sheet between the in-track axis and the edge abutment, (ii) toward the in-track axis to a position spaced from the in-track axis by a first predetermined distance so as to effect cross-track directional and skew alignment of the first sheet to the in-track axis, and (iii) away from the in-track axis to a position spaced from the in-track axis by a distance sufficient to allow loading a second cut sheet of predetermined width onto the tray surface with at least half of the width of the second sheet between the in-track axis and the edge abutment, the predetermined width of the second sheet being different from the predetermined width of the first cut sheet, and (iv) toward the in-track axis to a position spaced from the in-track axis by a second predetermined distance so as to effect cross-track and skew alignment of the second sheet to the center line, the second predetermined distance being different from the first predetermined distance by approximately one half the predetermined width of the difference between the width of the first cut sheet and the width of the second sheet.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art. While the invention is described below in the environment of a laser thermal printer, it will be noted that the invention can be used with other types of imaging apparatus.

Figure 1:
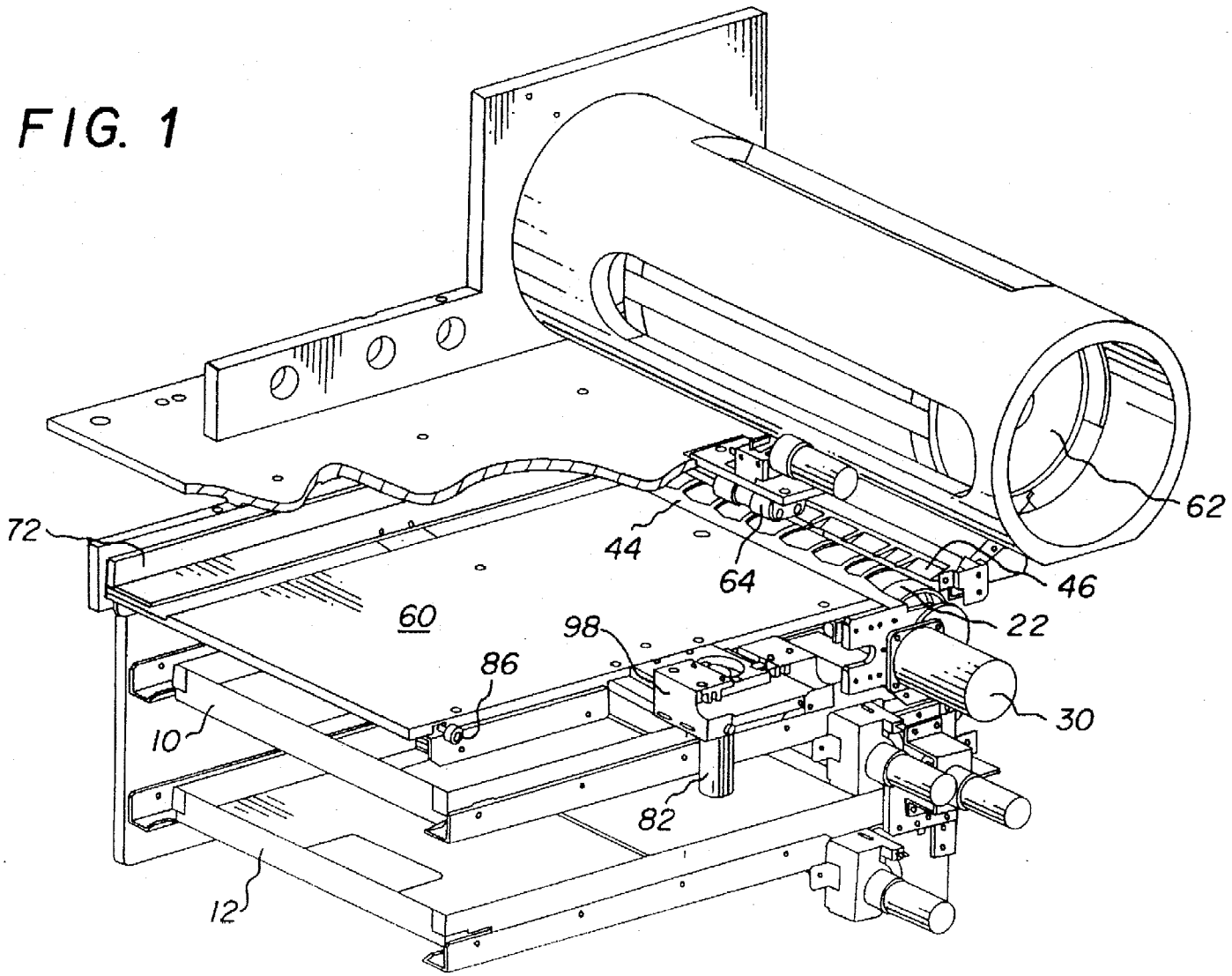
FIG. 1 is a perspective view, partially broken away, of imaging apparatus according to the present invention.
Figure 2:
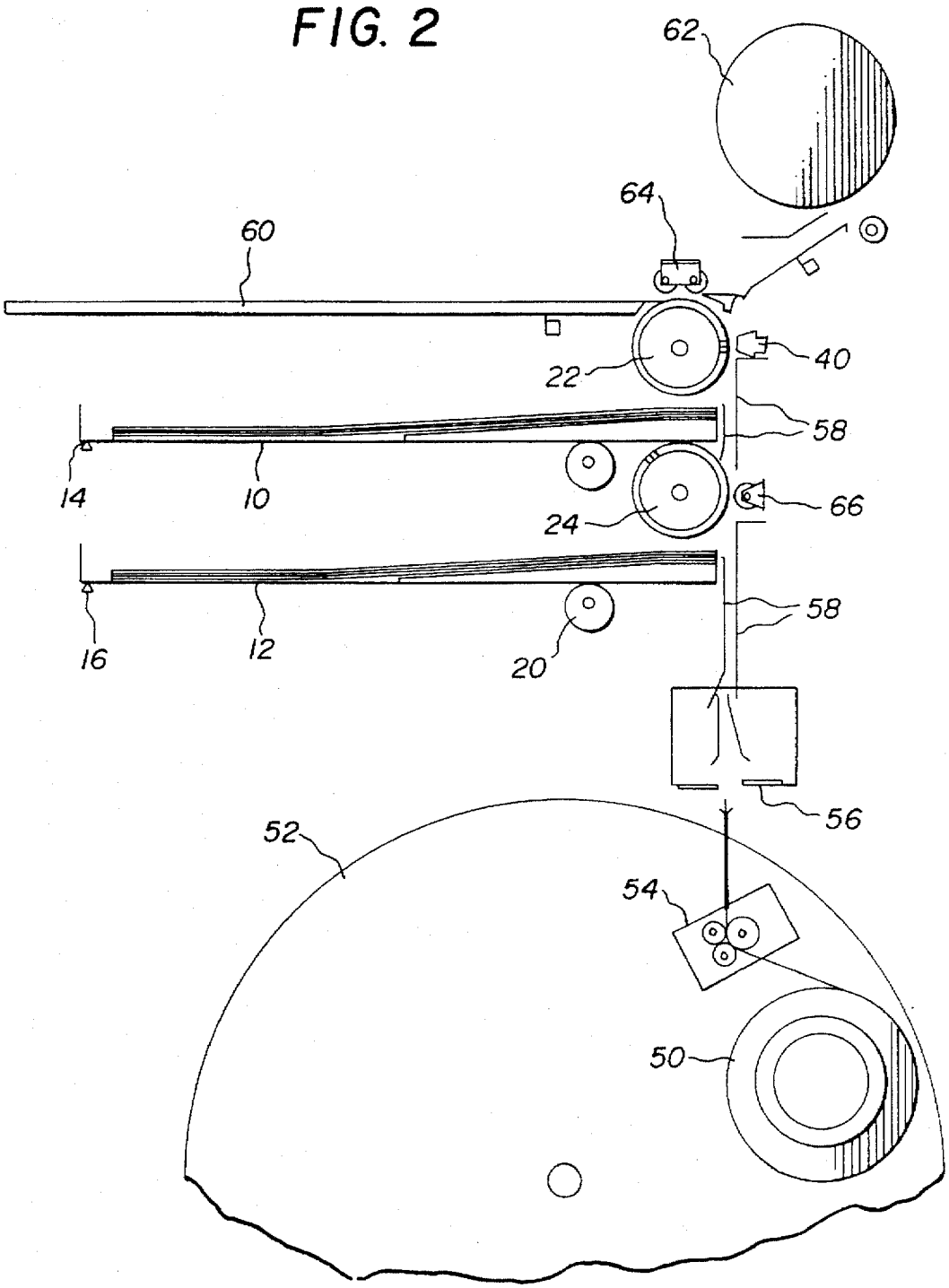
FIG. 2 is a schematic side view of the imaging apparatus of FIG. 1.

Referring to FIGS. 1 and 2, the imaging apparatus is provided with at least one receiver sheet tray. Two trays 10 and 12 are illustrated for either different receiver sheet characteristics or to provide a reserve tray which can be used when the main tray is empty and being re-loaded. Each tray 10 and 12 can be raised about a pivot point 14 and 16, respectively, by a cam 18 and 20 (FIG. 2) to bring the leading edge of the top sheet in the tray into contact with a rotary vacuum tube 22 and 24. Cams 18 and 20 are driven by motors 26 and 28, respectively, and rotary vacuum tubes 22 and 24 are driven by stepper motors 30 and 32, respectively (FIG. 1).

Figure 3:
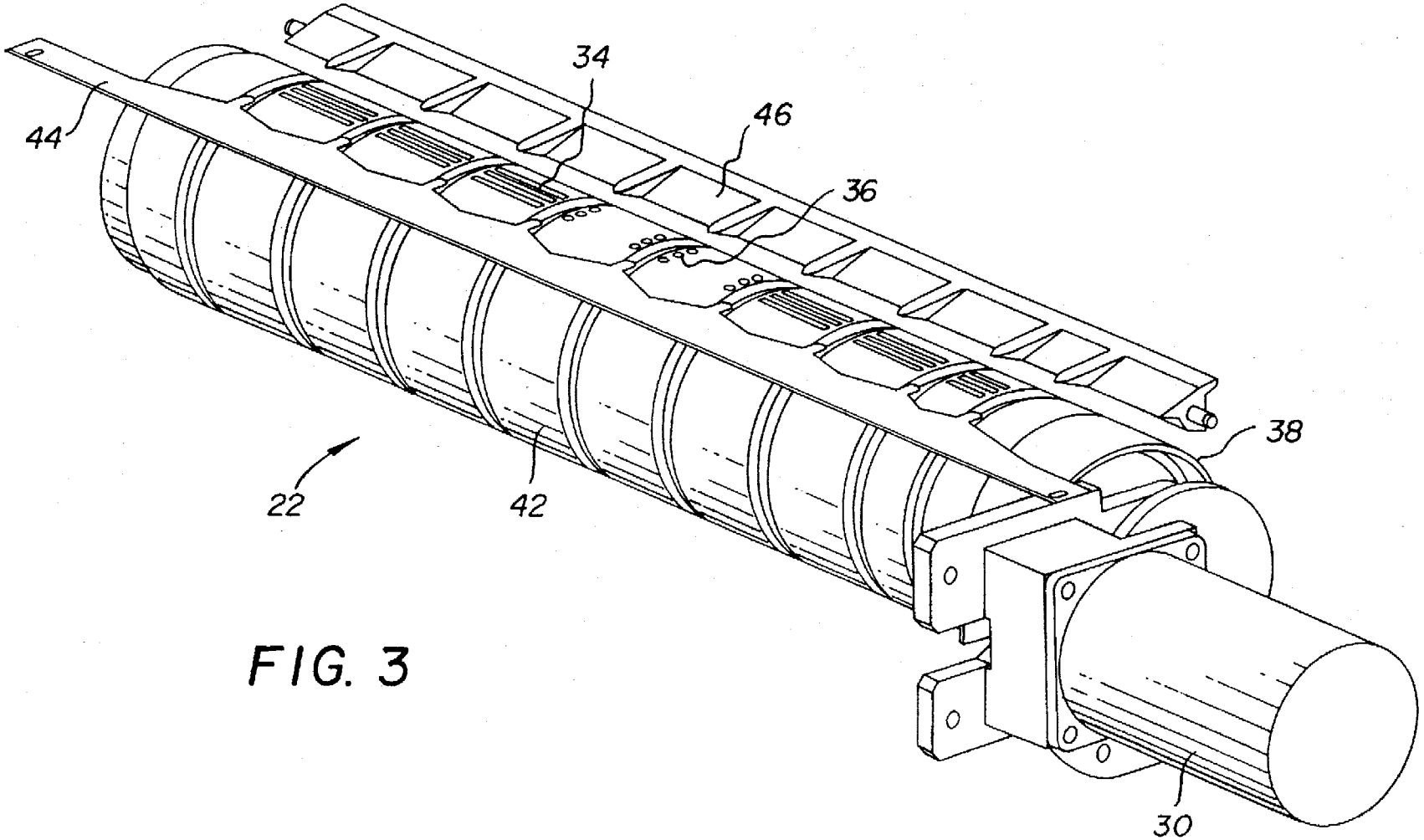
FIG. 3 is a perspective view of a detail of the imaging apparatus of FIG. 1.

Referring to FIG. 3, top rotary vacuum tube 22 has a plurality of vacuum slots 34 and vacuum holes 36. A slot at end 38 of tube 22 is detected by a sensor 40 (FIG. 2) to flag the tube's "home" position. A series of rubber compound surfaces 42 are molded onto an aluminum tube to increase friction drive for the cut sheets. A fixed skive bar 44 and a two-position skive bar 46 are provided.

Donor media is supplied from rolls (one roll 50 being illustrated in FIG. 2) carried on a rotating carousel 52. Each roll is associated with a feeder mechanism 54. When a donor sheet is required, the proper roll is indexed into alignment with a knife mechanism 56. The donor material is feed along a series of guides 58, and a sheet is trimmed by the knife mechanism.

In general, a receiver sheet is first delivered from one of the trays 10 and 12 to a justification tray 60. The sheet is cross-track aligned and skewed in the justification tray, and the sheet is then advanced to an imaging platen, such as a drum 62.

Figure 4:
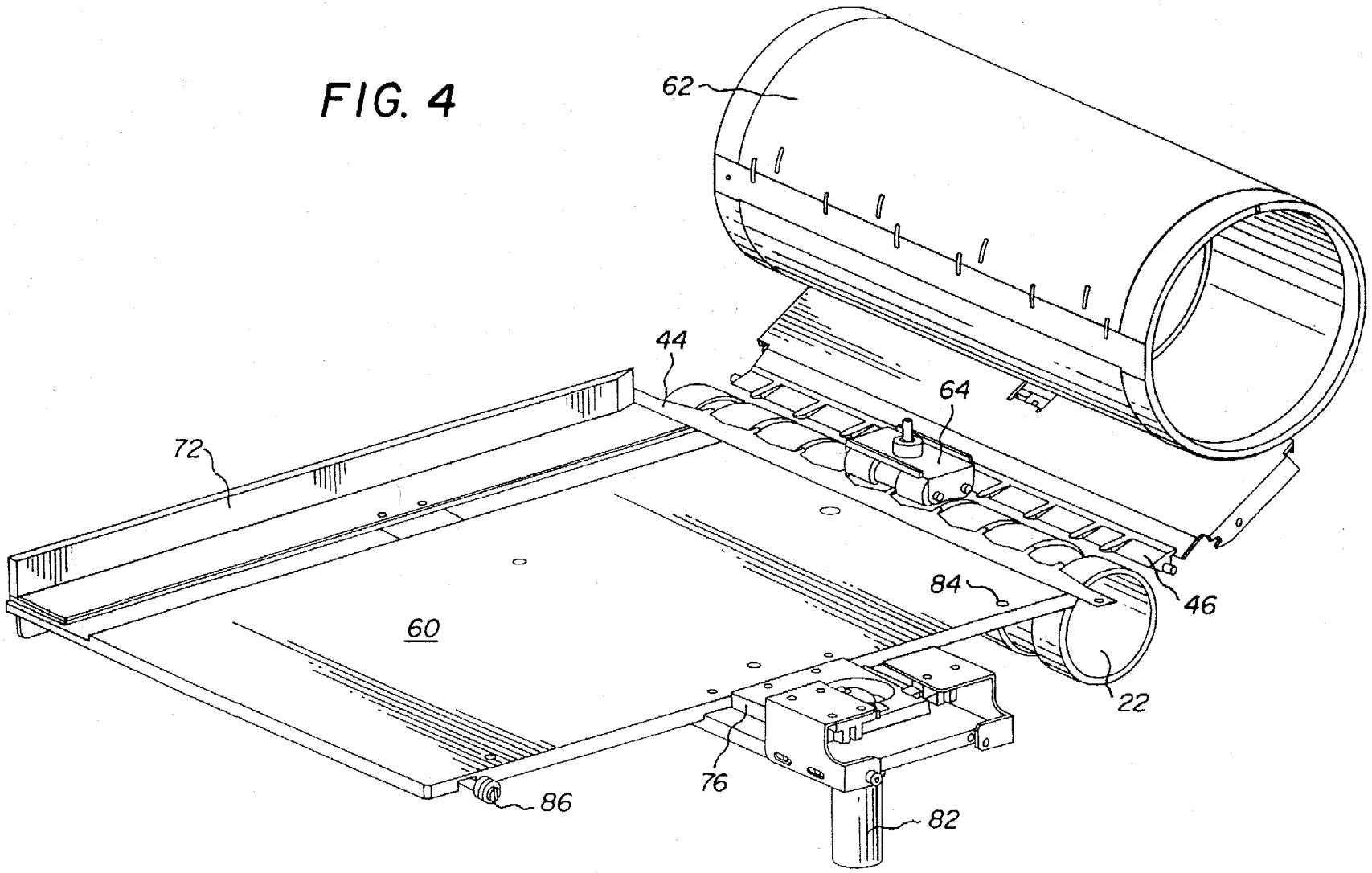
FIG. 4 is a perspective view of another detail of the imaging apparatus of FIG. 1.

Details of justification tray 60, which is supported on a frame partially shown in FIG. 1 at 68, will be discussed with particular reference to FIGS. 4 to 6. A sheet guide mechanism 70 is supported below tray 60. The guide mechanism includes a movable justification edge abutment 72 attached to a guide bar 74 that slides below tray 60. The end of the guide bar opposite to justification edge abutment 72 carries a cam plate 76 with a slot 78. An eccentric cam wheel 80 is driven by an electric cam motor 82. The angular orientation of tray 60 about a vertical axis at 84 can be adjusted by a screw 86 (FIGS. 1 and 3) to keep justification edge abutment 72 parallel to a line which is perpendicular to the rotary axis of rotary vacuum tube 22.

Figure 5:
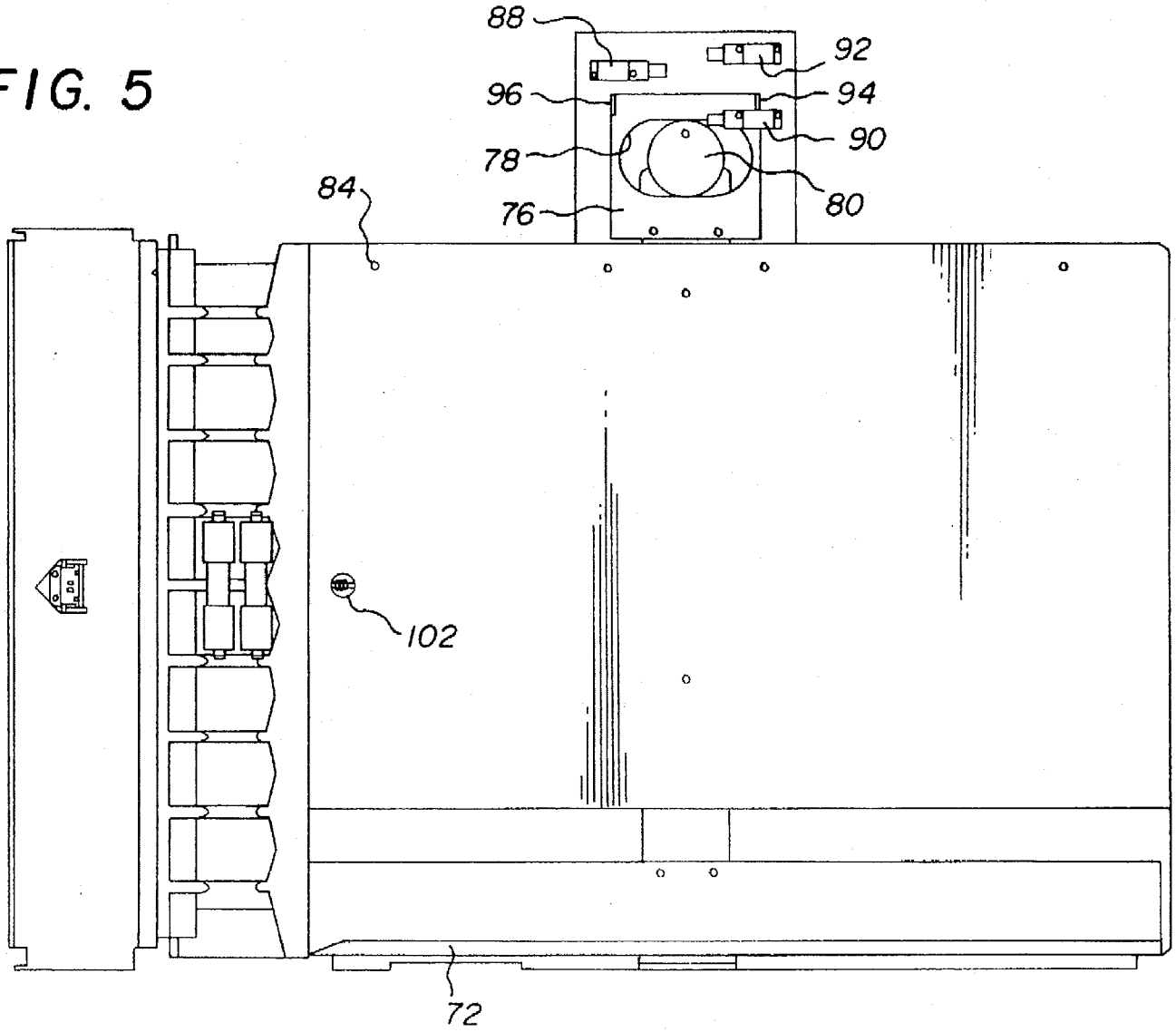
FIG. 5 is a top view of a detail of the imaging apparatus of FIG. 1.
Figure 6:
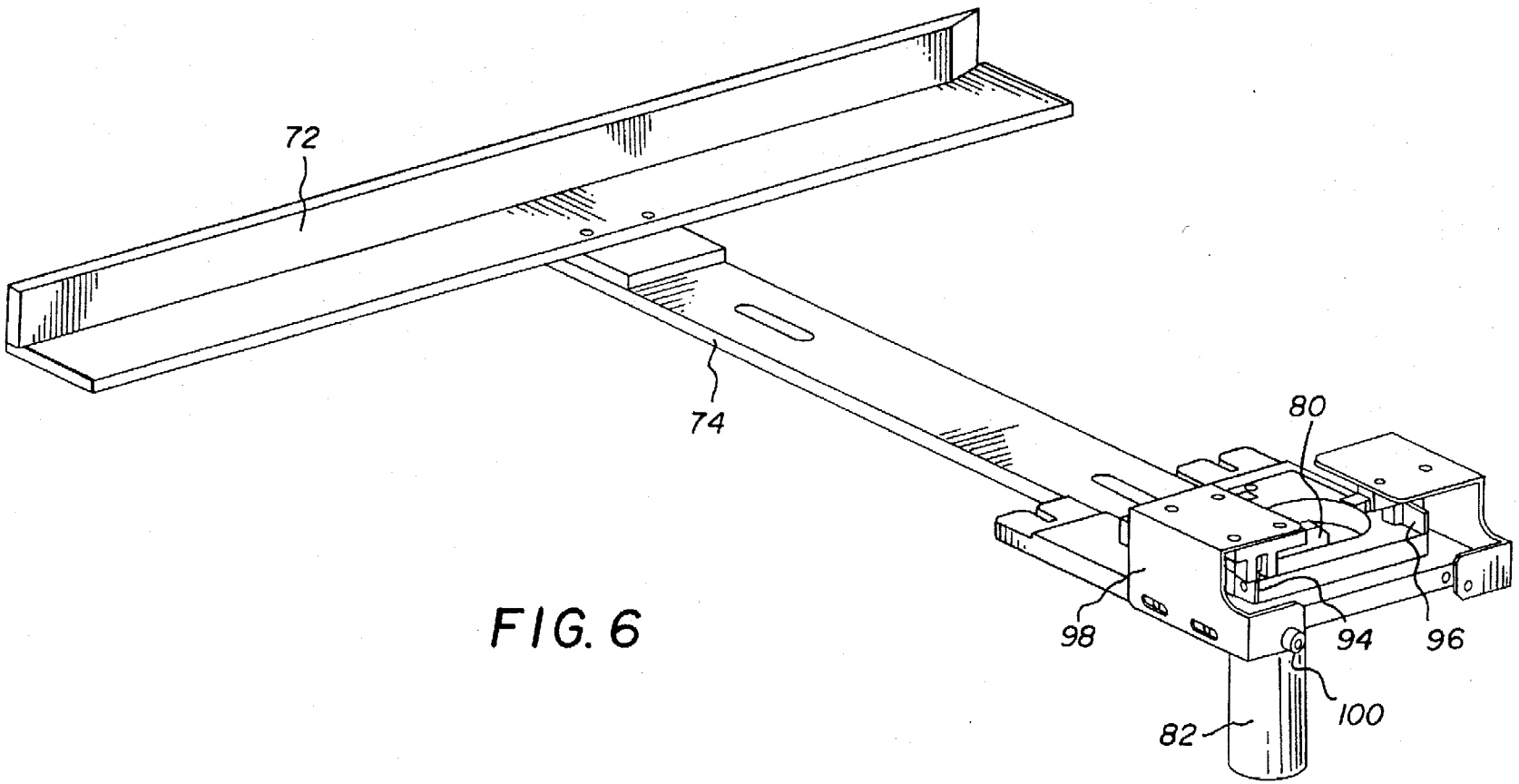
FIG. 6 is a perspective view of a detail of the imaging apparatus of FIG. 1.

Best seen in FIG. 5, there are three optical sensors 88, 90, and 92. Home sensor 90 detects the presence of a flag 94,,while donor sensor 88 and receiver sensor 92,detect two distinct positions of flags 94 and 96. The flags are attached to and move with guide bar 74 and justification edge abutment 72. The sensors are carried on a bracket 98 which can be adjusted by a screw 100.

Operation

Operation of the apparatus during a receiver sheet feed cycle will be explained with respect to FIGS. 1 to 6, and also with reference to FIGS. 7A to 7F, showing the stages of a receiver sheet justification.

Figure 7C:
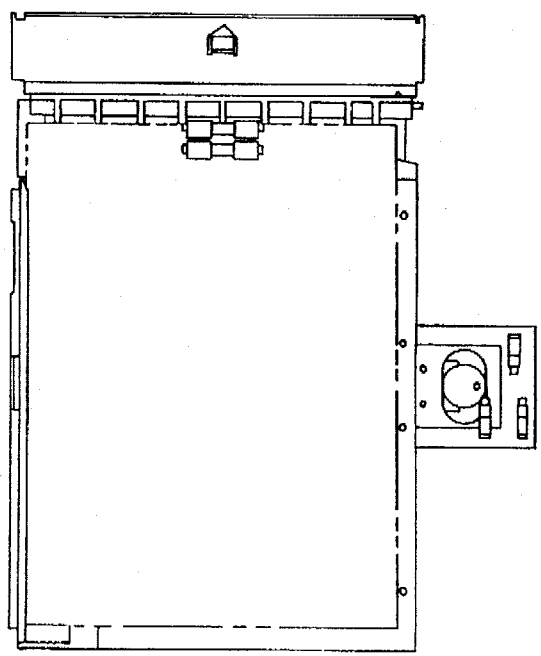
FIGS. 7A to 7F are a series of top views of a detail of the imaging apparatus of FIG. 1, showing the sequence of operation of the apparatus.
Figure 7B:
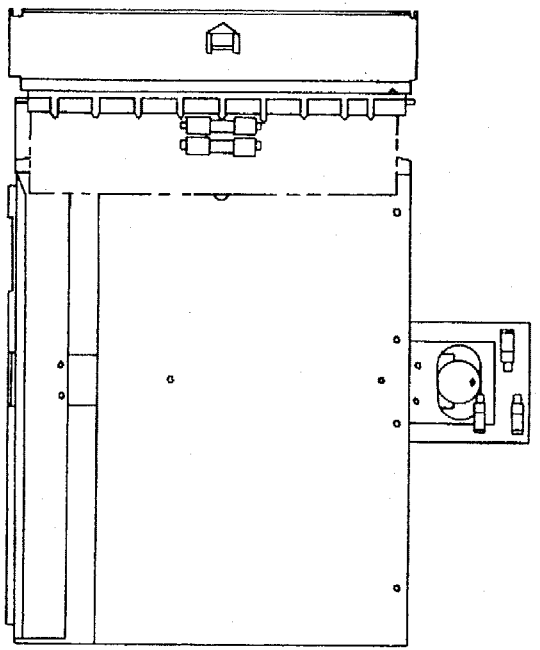
Figure 7A:
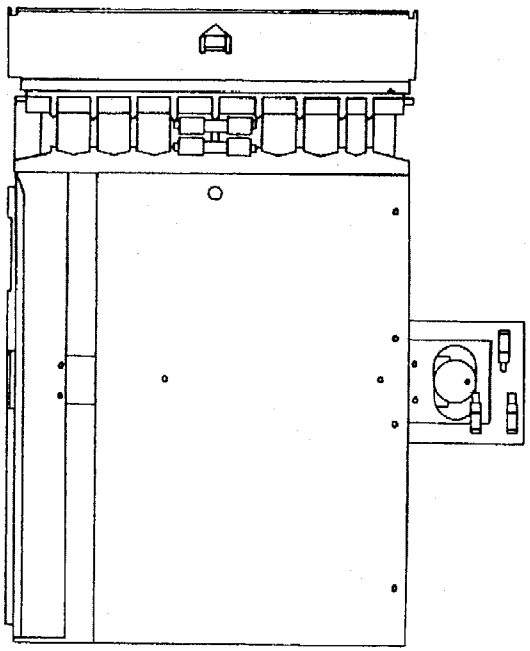
Figure 7F:
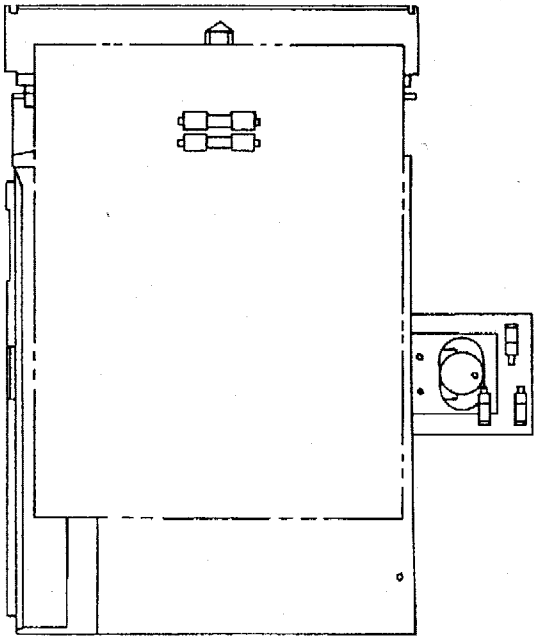
Figure 7E:
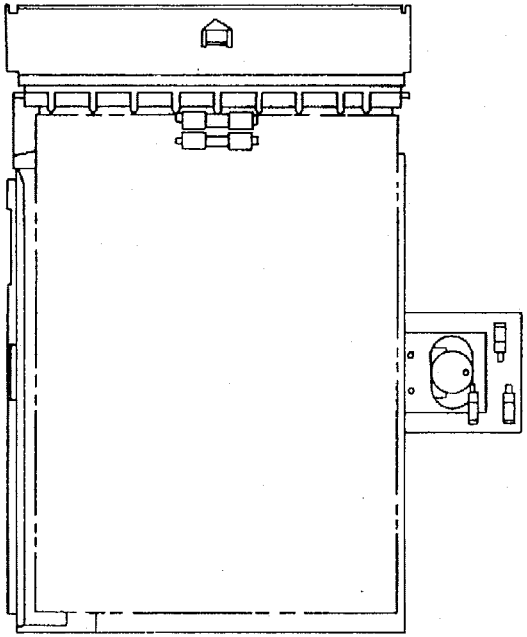

At the start of a sheet feed cycle, cam motor 82 is turned on to drive eccentric cam 80 to the position shown in FIG. 7A. This extends guide bar 74 and justification edge abutment 72 to clear tray 60 for a receiver sheet. The correct position of the cam is identified when flag 94 breaks the beam of home position optical sensor 90.

Rotary vacuum tubes 22 and 24 operate, with vacuum on, to pick up a receiver sheet from one of the supply trays 10 and 12. The rotary vacuum tube then is rotated by motor 30 or 32 to guide the sheet edge into position so that it can be clamped under a nip set 64 or 66, respectively. For receiver in top tray 14, this requires rotation of rotary vacuum tube 22 by 180 degrees. For receiver in bottom tray 12, rotation of only 90 degrees is required.

Once the receiver is under a nip set, the nip set engages. Now, the rotary vacuum tube vacuum turns off, and the rotary vacuum tube acts only as a drive roller for advancing the receiver sheet to justification tray 60. The leading edge of the receiver sheet is stripped from the rotary vacuum tube by a skive bar 44. Arrival of the leading edge of the receiver sheet at a predetermined position on justification tray 60 is detected by an optical sensor 102 as illustrated in FIG. 7B. Depending on the in-track length of the sheet, machine logic sets the distance that rotary vacuum tube 22 will drive the sheet; leaving the trailing edge of the sheet between the rotary vacuum tube and nip set 66 as shown in FIG. 7C.

Figure 7D:
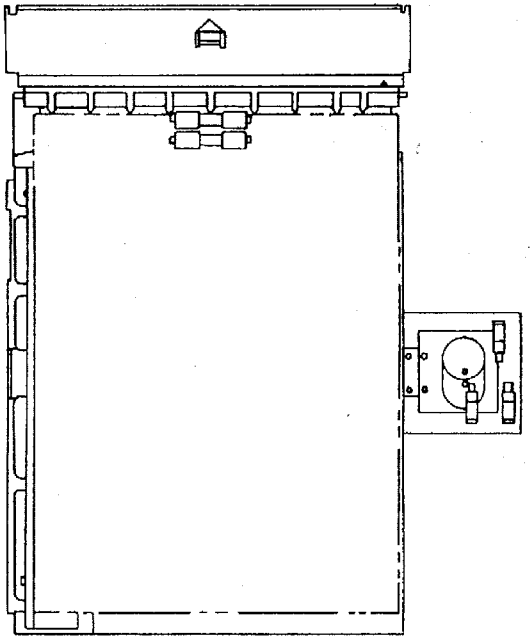

The nip set now disengages, leaving the sheet unconstrained on justification tray 60. Justification motor engages, and guide bar 74 and justification edge abutment 72 are pulled toward the sheet until receiver optical sensor 92 is tripped by flag 94, squaring the receiver to the justification edge abutment in the process as shown in FIG. 7D. When flag 94 trips sensor 92, the center of the receiver sheet is aligned with a predetermined axial position along imaging drum 62 as determined by the previously-mentioned adjustment of home sensor 90.

Nip set 66 is again engages to hold the receiver sheet to rotary vacuum tube 22 in the squared and centered location. Motor 82 is engaged to return guide bar 74 and justification edge abutment 72 to the home position of FIG. 7E. The receiver sheet is driven off the justification tray, FIG. 7F, and is tripped from the rotary vacuum tube by a second skive bar 46 for delivery to imaging drum 62.

Operation of the apparatus during a donor sheet feed cycle will be explained with respect to FIGS. 8A to 8F, showing the stages of a donor sheet justification.

Figure 8C:
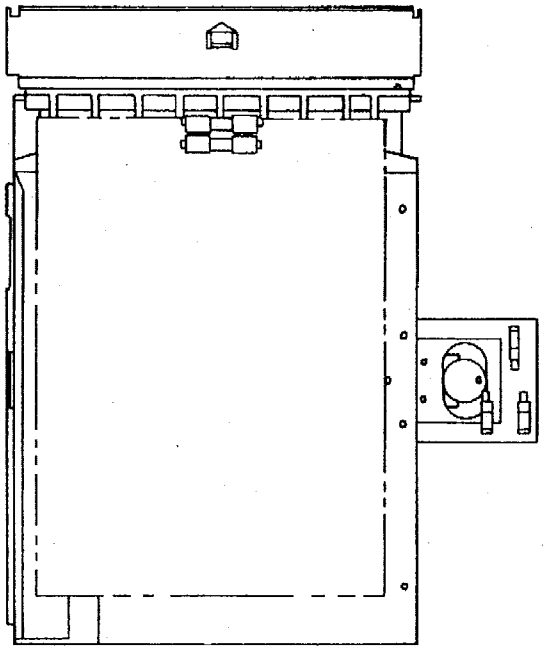
FIGS. 8A to 8F are a series of top views of a detail of the imaging apparatus of FIG. 1, showing the sequence of another operation of the apparatus.
Figure 8B:
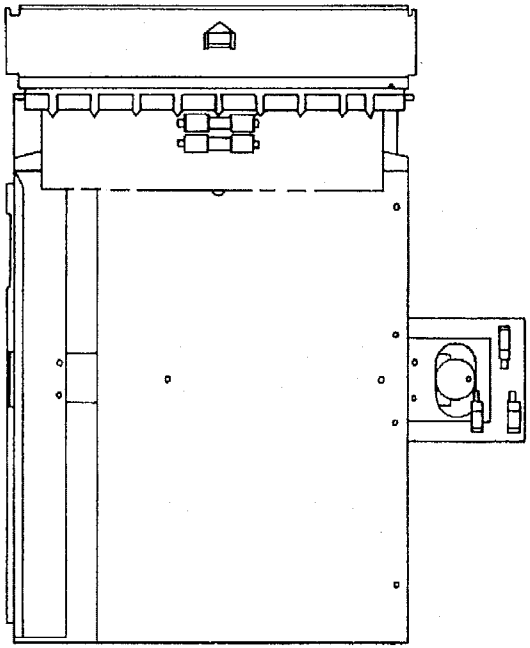
Figure 8A:
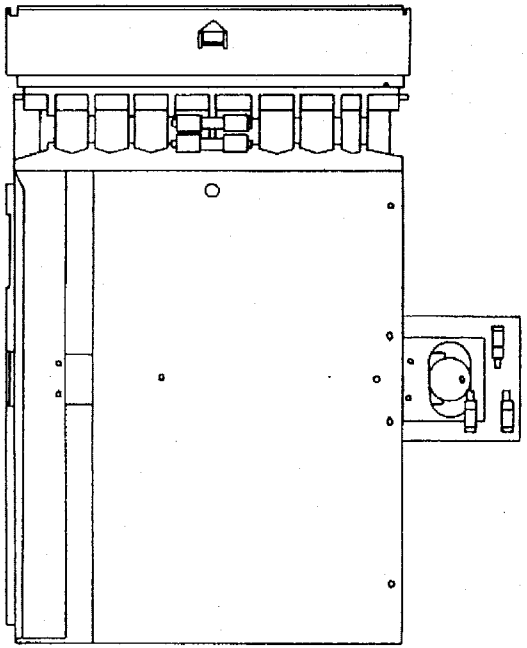
Figure 8F:
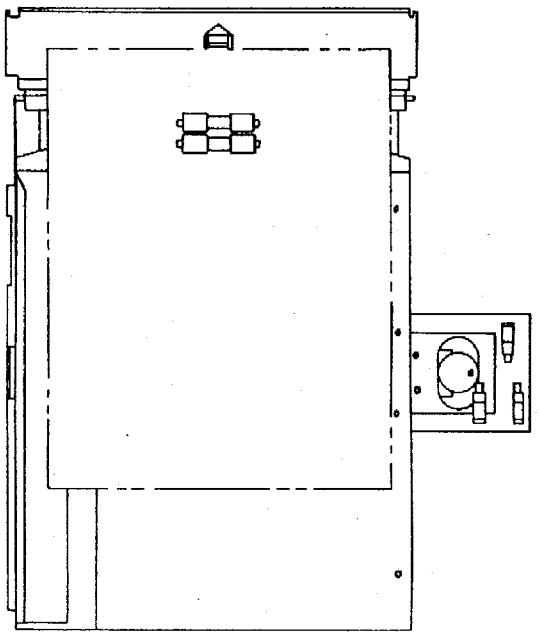
Figure 8E:
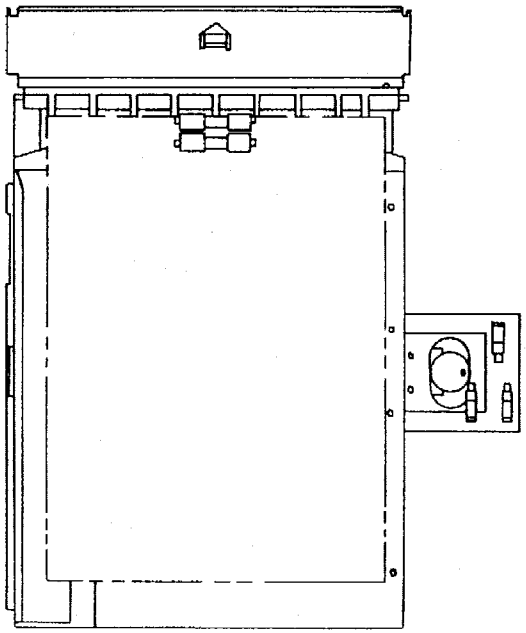

Assuming that cam motor 82 has driven eccentric cam 80 to the position shown in FIG. 8A to extend guide bar 74 and justification edge abutment 72 to clear tray 60 for a donor sheet, donor feeder mechanism 54 (FIG. 2) feeds donor web to rotary vacuum tubes 24 and 22, and the web is trimmed by knife mechanism 56. The rotary vacuum tubes act only as a drive rollers for advancing the donor sheet to justification tray 60. The leading edge of the donor sheet is stripped from the rotary vacuum tube by skive bar 44. Arrival of the leading edge of the donor sheet at a predetermined position on justification tray 60 is detected by optical sensor 102 as illustrated in FIG. 8B. Machine logic sets the distance that rotary vacuum tube 22 will drive the donor sheet; leaving the trailing edge of the sheet between the rotary vacuum tube and nip set 66 as shown in FIG. 8C.

Figure 8D:
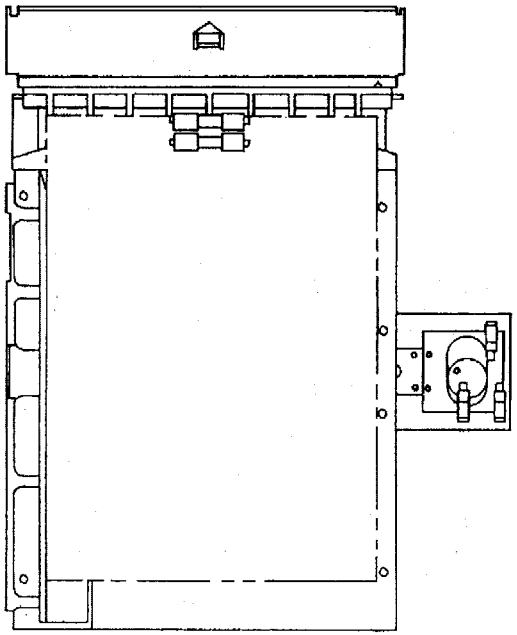

The nip set now disengages, leaving the donor sheet unconstrained on justification tray 60. Justification motor engages, and guide bar 74 and justification edge abutment 72 are pulled toward the donor sheet until donor optical sensor 88 is tripped by flag 96, squaring the receiver to the justification edge abutment in the process as shown in FIG. 8D. When flag 96 trips sensor 88, the center of the donor sheet is aligned with the afore-mentioned predetermined axial position along imaging drum 62 as determined by the previously-mentioned adjustment of home sensor 90.

Nip set 66 is again engages to hold the donor sheet to rotary vacuum tube 22 in the squared and centered location. Motor 82 is engaged to return guide bar 74 and justification edge abutment 72 to the home position of FIG. 8E. The donor sheet is driven off the justification tray, FIG. 8F, and is tripped from the rotary vacuum tube by second skive bar 46 for delivery to imaging drum 62.

As can be seen from the above description, 30 the sheet is completely unrestrained while being located and squared, greatly reducing the risk of abrasion or scratching. Because justification tray 60 has a single pivot point 84, skew (angular orientation) of the sheet can be adjusted relative to imaging drum 62 in the field using only screw 86. Sensors 88, 90, and 92 are also field-adjustable to allow for the best possible cross-track alignment of the sheet to the imaging drum.

The invention has been described in detail with particular reference to preferred embodiments thereof, but it will be understood that variations and modifications can be effected within the spirit and scope of the invention.

What is claimed is:

1. A justification apparatus for receiving cut sheets of different widths, for advancing the cut sheets from the justification apparatus along a path in an in-track direction of travel, and for effecting cross-track directional and skew alignment of the cut sheets relative to an in-track axis; said apparatus comprising:

a tray having a generally planar surface for receiving unconstrained cut sheets in the plane of the tray surface;

an edge abutment movable in opposed directions parallel to the plane of the tray surface, the edge abutment defining a surface parallel to the in-track axis and projecting from the tray surface so as to contact a side edge of a cut sheet received on the surface to move the cut sheet with the edge abutment;

means for sequentially moving the edge abutment (i) away from the in-track axis to a position whereat the edge abutment surface is spaced from the in-track axis by a distance sufficient to allow loading a first cut sheet of predetermined width onto the tray surface with more than half of the width of the first cut sheet between the in-track axis and the edge abutment, (ii) toward the in-track axis to a position whereat the edge abutment surface is spaced from the in-track axis by a first predetermined distance so as to effect cross-track directional and skew alignment of the first cut sheet to the in-track axis, and (iii) away from the in-track axis to a position whereat the edge abutment surface is spaced from the in-track axis by a distance sufficient to allow loading a second cut sheet of predetermined width onto the tray surface with at least half of the width of the second cut sheet between the in-track axis and the edge abutment, the predetermined width of the second cut sheet being different from the predetermined width of the first cut sheet, and (iv) toward the in-track axis to a position whereat the edge abutment surface is spaced from the in-track axis by a second predetermined distance so as to effect cross-track and skew alignment of the second cut sheet to the center line, the second predetermined distance being different from the first predetermined distance by approximately one half the predetermined width of the difference between the width of the first cut sheet and the width of the second cut sheet;

a guide bar movable in the cross-track direction, said edge abutment being attached to the guide bar for movement therewith;

a cam plate attached to the guide bar said cam late having a cam surface; and a cam adapted to engage the cam surface to move the cam plate in the cross-track direction.

2. A justification apparatus as set forth in claim 1 wherein the guide bar is mounted to slide below said tray surface.

3. A justification apparatus as set forth in claim 1 wherein:

the cam surface defines a slot in the cam plate; and the cam is an eccentric wheel rotatably mounted within the slot.

4. A justification apparatus as set forth in claim 1 wherein said second cut sheet is wider than the first cut sheet.

5. A justification apparatus as set forth in claim 1 further comprising means to adjust the angular orientation of the tray to align the edge with the center line.

6. A justification apparatus as set forth in claim 1 further comprising means for adjusting the edge abutment to align the edge abutment surface parallel to the center line.

7. A justification apparatus as set forth in claim 4 wherein the means for adjusting the edge abutment comprises means to change the rotational orientation of the tray about an axis normal to the planar surface of the tray.

* * * * *